US009651285B2

(12) United States Patent
Kim et al.

(10) Patent No.: US 9,651,285 B2
(45) Date of Patent: May 16, 2017

(54) REFRIGERATING CYCLE APPARATUS

(71) Applicant: LG ELECTRONICS INC., Seoul (KR)

(72) Inventors: Sangoh Kim, Seoul (KR); Hoyoun Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 861 days.

(21) Appl. No.: 13/898,665

(22) Filed: May 21, 2013

(65) Prior Publication Data

US 2013/0340454 A1 Dec. 26, 2013

(30) Foreign Application Priority Data

Jun. 22, 2012 (KR) ..... 10-2012-0067592

(51) Int. Cl.

| | |
|---|---|
| ***F25B 5/00*** | (2006.01) |
| ***F25B 39/02*** | (2006.01) |
| ***F25B 49/00*** | (2006.01) |
| ***F25B 1/10*** | (2006.01) |
| ***F25B 5/02*** | (2006.01) |
| ***F25B 41/04*** | (2006.01) |
| *F25B 31/00* | (2006.01) |

(52) U.S. Cl.

CPC ..... *F25B 49/00* (2013.01); *F25B 1/10* (2013.01); *F25B 5/02* (2013.01); *F25B 41/04* (2013.01); *F25B 31/004* (2013.01); *F25B 2500/06* (2013.01); *F25B 2600/2511* (2013.01)

(58) Field of Classification Search

USPC ..... 62/199, 200, 510

See application file for complete search history.

(56) References Cited

U.S. PATENT DOCUMENTS

| | | | | | |
|---|---|---|---|---|---|
| 4,204,148 | A * | 5/1980 | Gaertner | H02M 7/1626 | 323/238 |
| 4,544,863 | A * | 10/1985 | Hashimoto | H05B 41/2825 | 315/209 R |
| 5,743,098 | A * | 4/1998 | Behr | A47F 3/0408 | 62/199 |
| 6,370,895 | B1 * | 4/2002 | Sakuma | F25B 5/02 | 62/152 |
| 6,510,067 | B1 * | 1/2003 | Toebes | H02J 7/34 | 320/110 |
| 7,331,196 | B2 * | 2/2008 | Itsuki | F25B 5/02 | 62/510 |

(Continued)

*Primary Examiner* — Henry Crenshaw

(74) *Attorney, Agent, or Firm* — Ked & Associates LLP

(57) ABSTRACT

A refrigerating cycle apparatus is provided. The refrigerating cycle apparatus may include a refrigerant switching valve, which may be moved to a predetermined position through a simple circuit structure, during a blackout (power outage). Further, in a case in which input power is cut off due to a blackout, while the refrigerating cycle apparatus operates, oil may be collected. Even if input power is cut off due to a power outage, in a state in which the refrigerant switching valve is open while a refrigerating cycle apparatus having two compressors of two stages (2tage-2comp) is operating, the refrigerant switching valve may be converted to a closed state. This may reduce a pressure difference between the two compressors, and prevent damage to the compressors.

13 Claims, 6 Drawing Sheets

(56) References Cited

U.S. PATENT DOCUMENTS

| | | | | |
|---|---|---|---|---|
| 2002/0043073 | A1* | 4/2002 | Park | F25B 5/00 62/231 |
| 2003/0000241 | A1* | 1/2003 | Holz | F25B 5/02 62/440 |
| 2003/0133809 | A1* | 7/2003 | Iwanami | F04C 18/023 417/212 |
| 2004/0252481 | A1* | 12/2004 | Moon | G02F 1/133604 362/613 |
| 2006/0144063 | A1* | 7/2006 | Oh | F25B 49/022 62/200 |

* cited by examiner

REFRIGERATING CYCLE APPARATUS

CROSS-REFERENCE TO RELATED APPLICATION(S)

This application claims priority to Korean Application No. 10-2012-0067592, filed in Korea on Jun. 22, 2012, the contents of which is incorporated by reference herein in its entirety.

BACKGROUND

1. Field

A refrigerating cycle apparatus is disclosed herein.

2. Background

Refrigerating cycle apparatuses are known. However, they suffer from various disadvantages.

BRIEF DESCRIPTION OF THE DRAWINGS

Embodiments will be described in detail with reference to the following drawings in which like reference numerals refer to like elements, wherein.

DETAILED DESCRIPTION

Description will now be given in detail of embodiments, with reference to the accompanying drawings. For the sake of brief description with reference to the drawings, the same or equivalent components will be provided with the same reference numbers, and description thereof will not be repeated.

Generally, a refrigerating cycle apparatus is an apparatus capable of maintaining an inner state of a refrigerating machine, such as a refrigerator, at a low temperature, using a refrigerating cycle including a compressor, a condenser, an expander, and an evaporator. The refrigerating cycle apparatus may protect the compressor from mechanical friction using oil, and the oil may circulate through the refrigerating cycle, together with high temperature-high pressure refrigerant gas discharged from the compressor.

If the oil accumulates on or in the condenser, the evaporator, or a pipe of the refrigerating cycle, a capability of the refrigerating cycle may be lowered. Further, an amount of oil inside the compressor may become insufficient, thus causing damage to the compressor.

In a case of a refrigerating cycle apparatus having a plurality of compressors and a plurality of evaporators (a so-called 2stage-2comp refrigerating cycle apparatus), a refrigerant single-stage compressed by a primary compressor (low stage compressor) may be introduced into a secondary compressor (high stage compressor) to thus be two-stage compressed. The two-stage compressed refrigerant may circulate through the refrigerating cycle. Oil may be collected at or in the two compressors while circulating through the refrigerating cycle together with the refrigerant.

If an abnormal situation, such as a blackout (power outage), occurs with respect to an input power while the refrigerating cycle apparatus is operating, an amount of oil inside one compressor may be different from an amount of oil inside another or the other compressor. Especially, in a case in which the refrigerant switching valve is not closed while the refrigerating cycle apparatus is operating, there may occur a pressure difference between the two compressors. This may cause an imbalance in the amount of oil in the two compressors, which may damage the compressors.

Figure 1:
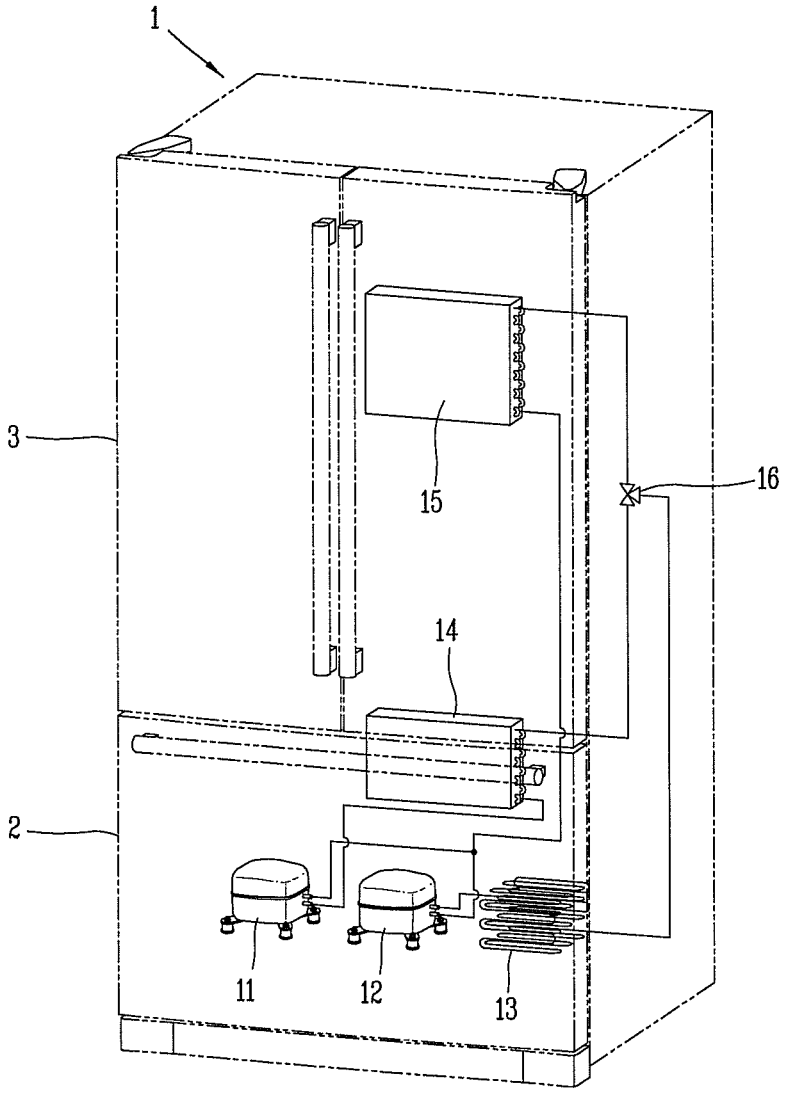
FIG. 1 is a schematic front perspective view of a refrigerator having a refrigerating cycle according to an embodiment.
Figure 2:
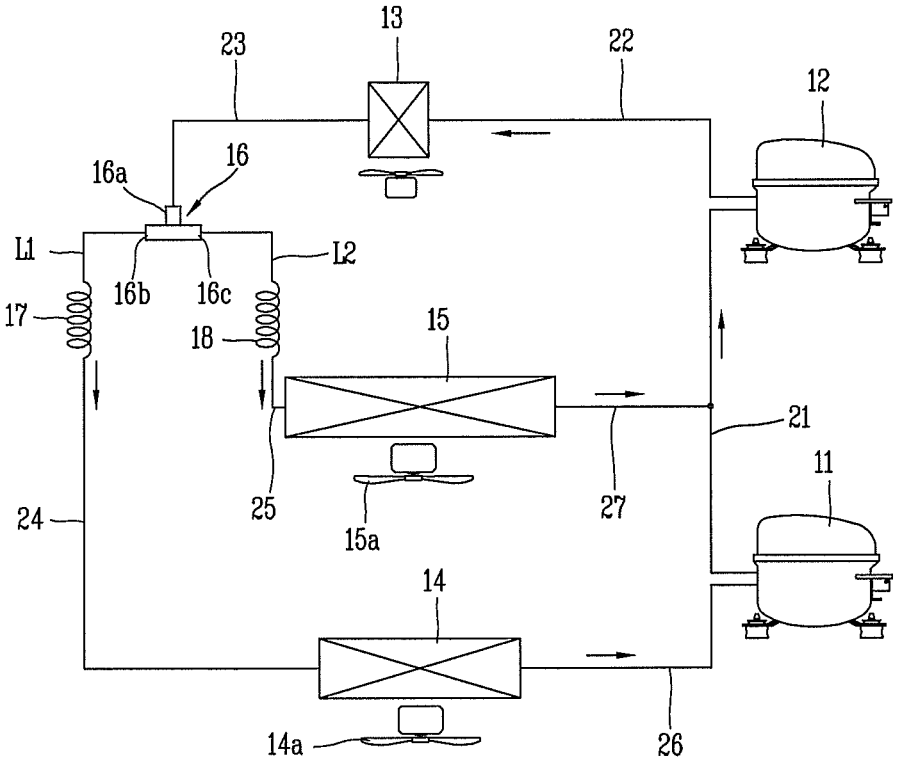
FIG. 2 is a systematic view of a refrigerating cycle apparatus applied to the refrigerator of FIG. 1.

Hereinafter, a refrigerator will be explained as an example of a refrigerating cycle apparatus. Referring to FIGS. 1 and 2, a refrigerator having a refrigerating cycle according to embodiments may include a refrigerator body 1 including a freezing chamber and a refrigerating chamber, and a freezing chamber door 2 and a refrigerating chamber door 3 configured to open and close the freezing chamber and the refrigerating chamber, respectively.

A mechanical chamber 10 may be provided at a lower portion of the refrigerator body 1. A plurality of compressors 11 and 12 and at least one condenser 13 of a refrigerating cycle to generate cool air may be installed in the mechanical chamber 10. A discharge opening of a primary compressor 11 may be connected to a suction opening of a secondary compressor 12 by a first refrigerant pipe 21, so that a refrigerant single-stage compressed by the primary compressor 11 of a relatively low pressure, may be second-stage compressed by the secondary compressor 12 of a relatively high pressure. A discharge opening of the secondary compressor 12 may be connected to an inlet of the condenser 13 by a second refrigerant pipe 22. The primary compressor 11 and the secondary compressor 12 may be designed to have a same capacity. However, the refrigerator may be designed so that the capacity of the secondary compressor 12, which drives the refrigerating chamber, may be greater than that of the primary compressor 11 by about two times, as the refrigerating chamber is more frequently driven than the freezing chamber in a general refrigerator.

A refrigerant switching valve 16 to switch a flowing direction of a refrigerant toward a first evaporator 14 or a second evaporator 15 to be explained hereinbelow, may be connected to an outlet of the condenser 13 by a third refrigerant pipe 23. The refrigerant switching valve 16 may be a 3-way valve. For example, the refrigerant switching valve 16 may include an inlet 16*a* connected to the outlet of the condenser 13, and a first outlet 16*b* and a second outlet 16*c* that selectively or simultaneously communicate with the inlet 16*a*. A first branched-pipe L1 may be connected to the first outlet 16*b*, and a second branched-pipe L2 may be connected to the second outlet 16*c*.

A first expander 17 may be connected to the first branched-pipe L1, a fourth refrigerant pipe 24 may be connected to an outlet of the first expander 17, and a first evaporator 14 to cool the freezing chamber may be connected to the fourth refrigerant pipe 24. A second expander 18 may be connected to the second branched-pipe L2, a fifth refrigerant pipe 25 may be connected to an outlet of the second expander 18, and a second evaporator 15 to cool the refrigerating chamber may be connected to the fifth refrigerant pipe 25.

The first evaporator 14 and the second evaporator 15 may have a same capacity. However, like with the compressors, the second evaporator 15 may have a capacity larger than that of the first evaporator 14. Blowing fans 14*a* and 15*a* may be installed at one side of the first evaporator 14 and the second evaporator 15, respectively.

An outlet of the first evaporator 14 may be connected to a suction side of the primary compressor 11 by a sixth refrigerant pipe 26, whereas an outlet of the second evaporator 15 may be connected to a suction side of the secondary compressor 12 by a seventh refrigerant pipe 27. The seventh refrigerant pipe 27 may not be directly connected to the suction side of the secondary compressor 12, but rather, may be indirectly connected thereto by being merged with a central portion of the first refrigerant pipe 21 connected to an outlet of the primary compressor 11. With such a configuration, the first evaporator 14 and the second evaporator 15 may be connected to each other in parallel.

The refrigerator may operate in a simultaneous driving mode, to drive or operate both the freezing chamber and the refrigerating chamber, by controlling a flowing direction of a refrigerant toward the first evaporator 14 or the second evaporator 16, using the refrigerant switching valve 16. Alternatively, the refrigerator may operate in a freezing chamber driving mode to drive or operate only the freezing chamber, or in a refrigerating chamber driving mode to drive or operate only the refrigerating chamber. In the case of the simultaneous driving mode to drive or operate both the freezing chamber and the refrigerating chamber, both the first outlet 16*b* and the second outlet 16*c* of the refrigerant switching valve 16 may be open, thereby allowing a refrigerant passing through the condenser 13 to move toward the first evaporator 14 and the second evaporator 15.

The refrigerant sucked into the primary compressor 11 via the first evaporator 14 may be single-stage compressed at or in the primary compressor 11 and then discharged. The single-stage compressed refrigerant discharged from the primary compressor 11, may be sucked to the secondary compressor 12. As the refrigerant passing through the second evaporator 15 moves to the first refrigerant pipe 21 via the seventh refrigerant pipe 27, the refrigerant may be mixed with the single-stage compressed refrigerant discharged from the primary compressor 11, and then may be sucked to the secondary compressor 12.

The single-stage compressed refrigerant, that is, the refrigerant passing through the second evaporator 15, may be compressed by the secondary compressor 12 and then discharged. The refrigerant discharged from the secondary compressor 12 may move to the condenser 13 to thus be condensed. Then, the refrigerant condensed by the condenser 13 may be diverged toward the first evaporator 14 and the second evaporator 15, by the refrigerant switching valve 16, and circulate. Such an operation may be repeatedly performed.

In a case of the freezing chamber driving mode, the second outlet 16*c*, that is, refrigerating chamber side evaporator, of the refrigerant switching valve 16 may be closed, whereas the first outlet 16*b*, that is, freezing chamber side evaporator, may be open. With such a configuration, the refrigerant passing through the condenser 13 may move only toward the first evaporator 14. The primary compressor 11 and the secondary compressor 12 may be simultaneously driven, so that the refrigerant passing through the first evaporator 14 may circulate while being two-stage compressed in the primary compressor 11 and the secondary compressor 12, sequentially.

In a case of the refrigerating chamber driving mode, the second outlet 16*c* of the refrigerant switching valve 16 may be open, whereas the first outlet 16*b* may be closed. Only the secondary compressor 12 may be driven in a state in which the primary compressor 11 is stopped. With such a configuration, the refrigerant passing through the condenser 13 may move only toward the second evaporator 15, to thus be single-stage compressed by the secondary compressor 12. Then, the single-stage compressed refrigerant may move to the condenser 13. Such an operation may be repeatedly performed.

In a case in which the primary compressor 11 and the secondary compressor 12 are serially connected to each other via the first refrigerant pipe 21 so as to perform two-stage compression, oil inside the primary compressor 11, a low stage compressor, may be discharged together with the refrigerant, to thus move to the secondary compressor 12, a high stage compressor. As a result, in the primary compressor 11, the amount of oil discharged may be greater than the amount of oil collected.

Figure 9:
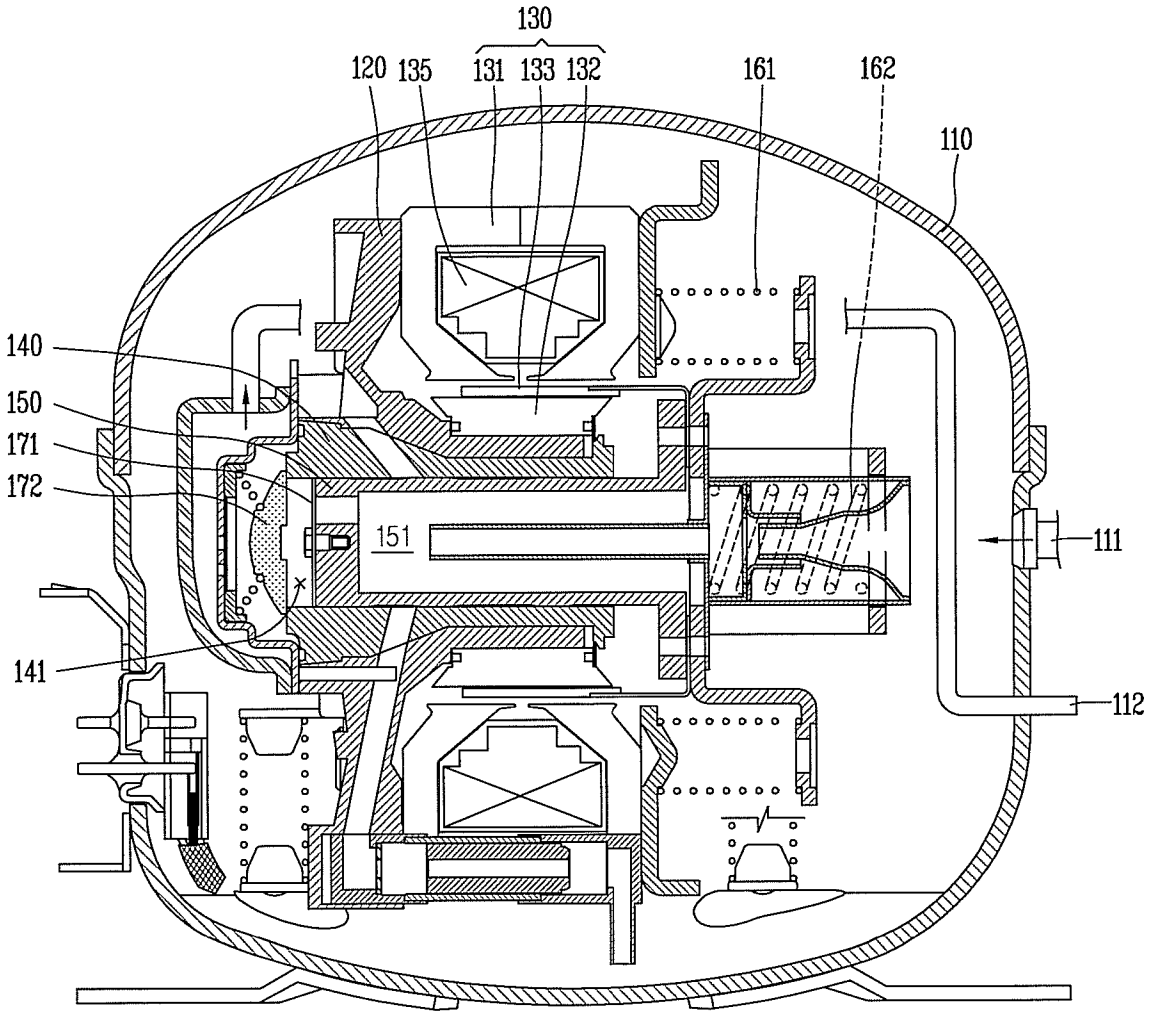
FIG. 9 is a sectional view of a compressor provided in a refrigerating cycle apparatus according to embodiments.

Referring to FIG. 9, in a compressor provided in a refrigerating cycle apparatus according to embodiments, a frame 120 may be elastically installed at or in an inner space of a hermetic shell 110, and a reciprocating motor 130 and a cylinder 140 may be fixed to the frame 120. A piston 150 coupled to a mover 133 of the reciprocating motor 130 may be inserted into the cylinder 140, so as to perform a reciprocating motion. A plurality of resonance springs 161 and 162 to induce a resonance motion of the piston 150 may be installed at both sides of the piston 150 in a moving direction.

A compression space 141 may be formed at or within the cylinder 140, a suction channel 151 may be formed at or in the piston 150, and a suction valve 171 to operate and close the suction channel 151 may be installed at an end of the suction channel 151. A discharge valve 172 to open and close the compression space 141 of the cylinder 140 may be installed at a fore end of the cylinder 140.

A suction pipe 111 connected to a discharge pipe (not shown) of the primary compressor 11 may communicate with an inner space of the shell 110. A discharge pipe 112 connected to an inlet of the condenser 13 of the refrigerating cycle apparatus, may be installed at one side of the suction pipe 111. Unexplained reference numeral 135 denotes a coil.

Once power is supplied to the coil 135 of the reciprocating motor 130 of the secondary compressor 12, the mover 133 of the reciprocating motor 130 may perform a reciprocating motion. Then, the piston 150 coupled to the mover 133 may suck refrigerant discharged after being single-stage compressed by the primary compressor 11 into the shell through the suction pipe 111, while linearly reciprocating in the cylinder 140. The refrigerant inside the shell 110 may be sucked into the compression space 141 of the cylinder 140, through the suction channel 151 of the piston 150. When the piston 150 performs a forward motion, the refrigerant may be discharged from the compression space 141, to thus move to the condenser 13 of the refrigerating cycle apparatus through the discharge pipe 112.

Figure 3:
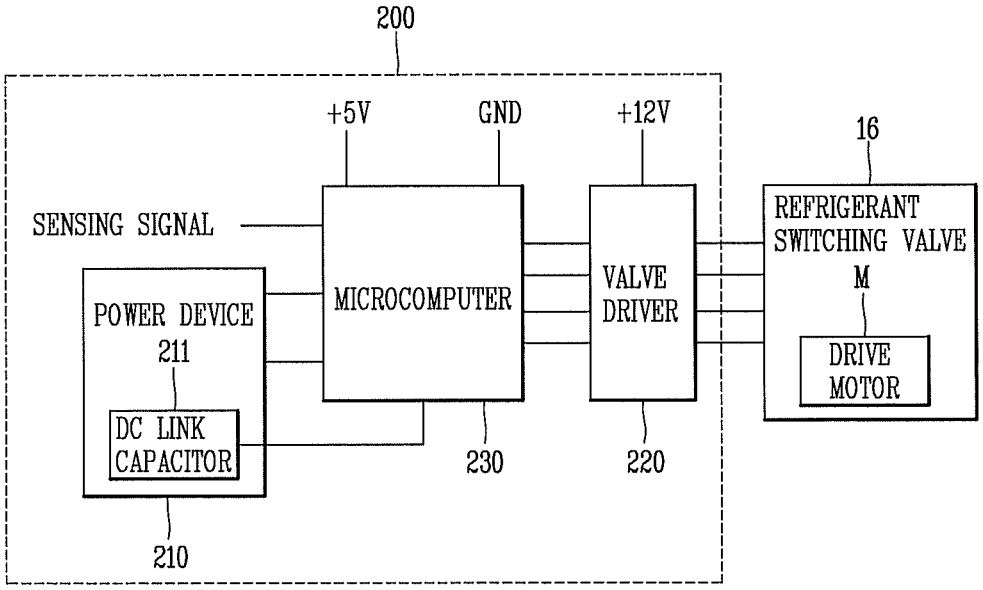
FIG. 3 is a block diagram of a refrigerating cycle apparatus according to an embodiment.

Referring to FIG. 3, the refrigerating cycle apparatus according to an embodiment may include the refrigerant switching valve 16 provided with a drive motor (M) driven according to a valve driving signal. The refrigerant switching valve 16 may switch a refrigerant path by being opened and closed as the drive motor M is driven. The refrigerant switching valve 16 may be installed at an outlet of the condenser 13, on a divergence point into the first evaporator 14 and the second evaporator 15. The refrigerant switching valve 16 may be switched as the drive motor (M) is driven, thereby supplying refrigerant to the first evaporator 14 or the second evaporator 15.

As shown in FIG. 3, a controller 200 of the refrigerating cycle apparatus may include a power device 210, a valve driver 220, and a microcomputer 230. The power device 210 may be provided with a direct current (DC) link capacitor 211 configured to store a DC voltage therein. The power device 210 may receive a commercial AC power, and convert an AC voltage of the commercial AC power into one or more drive voltages, to thus output the drive voltages. The commercial AC power may be a so-called 'wall power source', which generally has a voltage of about 50 or 60 Hz and about 110, 220, or 380V. The drive voltage may have a value of +3.3V, +5V, or +12V, for example. The DC link capacitor 211 generally performs a smoothing function. In order for the DC link capacitor to supply power during a blackout (power outage), a capacity of the DC link capacitor 211 should be increased.

Figure 6:
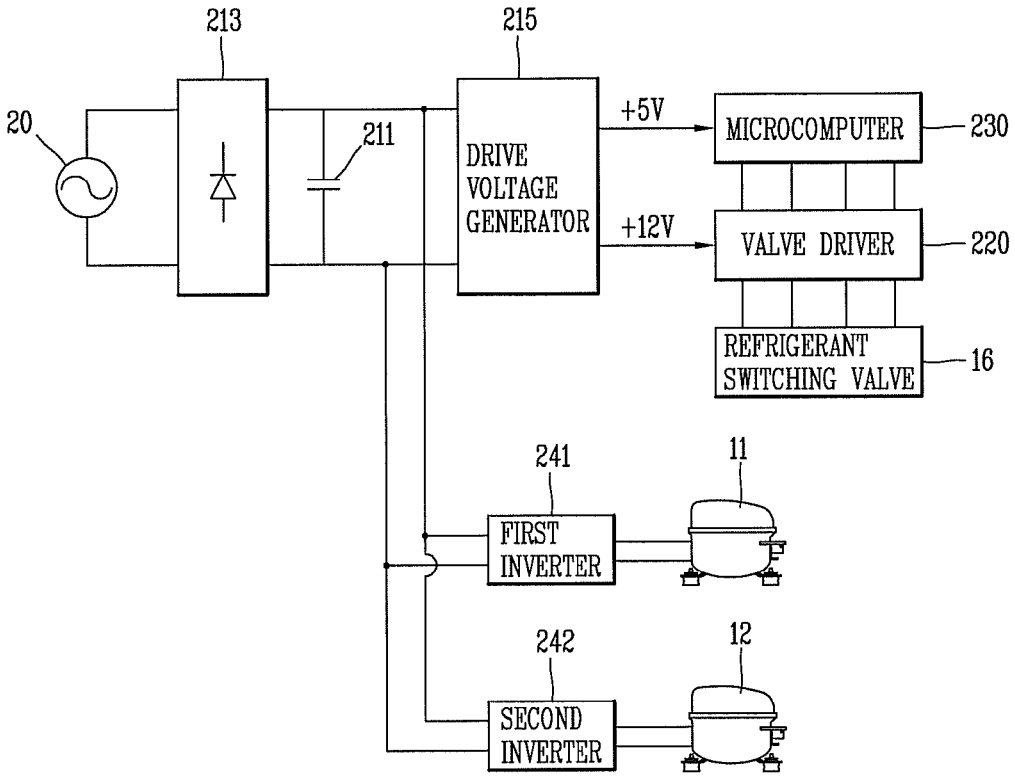
FIGS. 6 and 7 are block diagrams schematically showing a refrigerating cycle apparatus according to another embodiment.

Referring to FIG. 6, the power device 210 may further include a converter 213 connected to a front end of the DC link capacitor 211, and configured to convert an AC voltage into a DC voltage. The converter 213 may serve as an AC-DC conversion device, and may be implemented, for example, as a combination of a plurality of diodes, for example, a full bridge diode. The power device 210 may further include a drive voltage generator 215 connected to a rear end of the DC link capacitor 211, and configured to convert a DC voltage into drive voltages. Generally, a switch mode power supply (SMPS) may be used as the drive voltage generator 215.

The valve driver 220 may receive one or a first drive voltage (+12V in FIG. 3), among the one or more drive voltages output from the drive voltage generator 215, and output a valve driving signal to the drive motor (M). The valve driver 220 may be differently configured according to a type or form of the drive motor (M).

As the drive motor (M) to drive the refrigerant switching valve 16, a stepper motor may be used. The stepper motor is a motor that rotates by a prescribed angle, by a pulse wave voltage. The rotational angle may be proportional to a number of input pulse signals, and a rotational speed may be proportional to a frequency of an input pulse signal.

In a case in which the refrigerant switching valve 16 is a 3-way valve, as shown in FIG. 2, and a stepper motor may be used as the drive motor (M) to drive the refrigerant switching valve 16, and a number of types of an input pulse signal of the stepper motor may be four (4). That is, the refrigerant switching valve 16 may have the following four (4) states, a state in which the first outlet 16*b* and the second outlet 16*c* are open; a state in which the first outlet 16*b* is open, but the second outlet 16*c* is closed; a state in which the first outlet 16*b* is closed, but the second outlet 16*c* is open; and a state in which the first outlet 16*b* and the second outlet 16*c* are closed. The microcomputer 230 may perform the four (4) stages in a preset order, and may store therein a current state of the refrigerant switching valve 16 in a case of an operation during a blackout (power outage).

The microcomputer 230 may receive one or a second drive voltage (+5V in FIG. 3) among the one or more drive voltages, or may receive a DC voltage stored in the DC link capacitor 211, thereby generating a valve driving signal. If a supply of the commercial AC power 20 stops, the microcomputer 230 may generates a valve driving signal instructing all of the four (4) states of the refrigerant switching valve 16 to be closed. For instance, the microcomputer 230 may store a current state of the refrigerant switching valve among the four (4) states while the refrigerating cycle apparatus operates. Then, in the occurrence of a blackout (power outage), the microcomputer 230 may generate a valve driving signal to thus output the valve driving signal to the valve driver 220, the valve driving signal instructing both the first outlet 16*b* and the second outlet 16*c* of the refrigerant switching valve to be closed.

Figure 4:
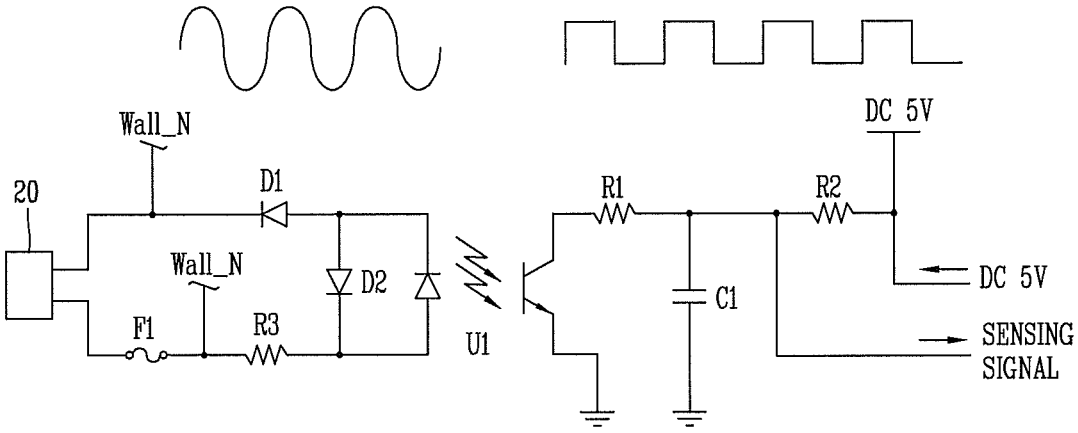
FIG. 4 is a circuit diagram of a power outage sensing circuit provided in a refrigerating cycle apparatus according to embodiments.

The refrigerating cycle apparatus may further include a power outage sensing circuit (not shown) connected to a commercial AC power source 20, and configured to sense whether supply of the commercial AC power has been stopped. FIG. 4 shows an example of a power outage sensing circuit using a photo coupler U1. Referring to FIG. 4, an input terminal of the photo coupler U1 may be connected to the commercial AC power source 20, through a fuse F1, a plurality of diodes D1 and D2, and a passive element R3. An output terminal of the photo coupler U1 may be connected to the microcomputer 230 through passive elements R1, R2 and C1. The power outage sensing circuit may receive one or a third drive voltage among the one or more drive voltages from the power device 210. The power outage sensing circuit may check a frequency of a commercial AC power, and transmits a sensing signal having a prescribed frequency to the microcomputer 230. For instance, in a case in which a commercial AC power of about 60 Hz and 220V is connected to the power outage sensing circuit, the microcomputer 230 may consecutively receive, from the power outage sensing circuit, a sensing signal of a square wave pulse corresponding to about 60 Hz.

Figure 8:
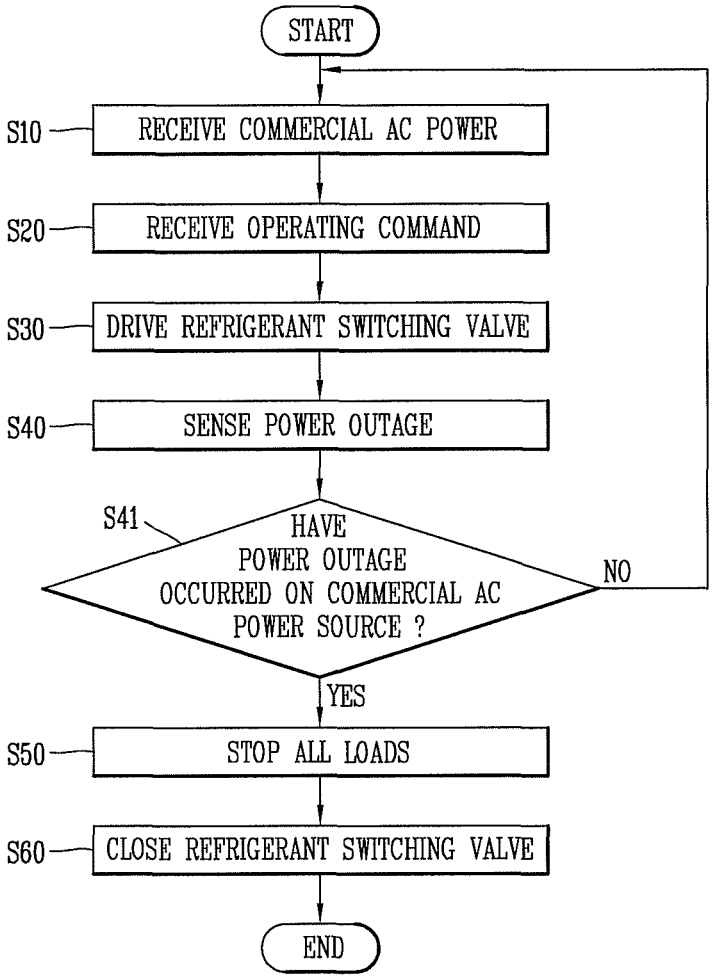
FIG. 8 is a flowchart of a control operation of a refrigerating cycle apparatus according to an embodiment.

Hereinafter, an operation for controlling the refrigerating cycle apparatus according to embodiments will be explained with reference to FIG. 8. First, the refrigerating cycle apparatus may receive an AC power of a prescribed frequency and a prescribed voltage, from the commercial AC power source, in step S10. Then, the refrigerating cycle apparatus may receive an operating command from a user, or in correspondence to a load, in step S20. The refrigerating cycle apparatus may drive the compressor, the condenser, the refrigerant switching valve, for example, according to the operating command, in step S30. The refrigerating cycle apparatus may sense, during the operation, using the power outage sensing circuit, whether the commercial AC power is continuously applied to the refrigerating cycle apparatus, and so on, in step S40. If a power outage occurs on the commercial AC power source, in step S41, the refrigerating cycle apparatus may stop all loads, in step S50. Here, the loads indicate all components of the refrigerating cycle apparatus. In the occurrence of a blackout (power outage), an input power supplied to the refrigerant switching valve may be cut off, and the refrigerant switching valve may maintain the power-off state. In a case in which the refrigerant switching valve is open, there may occur a pressure difference between the primary compressor and the secondary compressor, and unbalance in the amount of oil inside the two compressors. The refrigerating cycle apparatus may control the refrigerant switching valve to be in a closed state, using a current (voltage) remaining on the DC link capacitor, in step S60.

Referring to FIG. 6, the controller 200 of the refrigerating cycle apparatus may further include a first inverter 241 and a second inverter 242 configured to convert a DC voltage into drive voltages with respect to the primary compressor 11 and the secondary compressor, and to apply the drive voltages to the primary compressor 11 and the secondary compressor 12. The controller 200 may drive the primary compressor 11 and the secondary compressor 12 individually or simultaneously. For instance, the refrigerating cycle apparatus may simultaneously drive both the freezing chamber and the refrigerating chamber, or may drive one of the freezing chamber and the refrigerating chamber. The first inverter 241 and the second inverter 242 may include a plurality of switching devices, and initially operate to drive the primary compressor 11 and the secondary compressor 12 according to a first control signal and a second control signal of the microcomputer. If necessary, the first inverter 241 and the second inverter 242 may be configured as a single inverter. The first control signal and the second control signal may be signals having undergone a pulse width modulation (PWM), such as a space vector pulse width modulation (SVPWM).

Rather than the first inverter and the second inverter, a first AC switch and a second AC switch may be used. The first AC switch and the second AC switch may be devices that apply a motor drive voltage and a motor drive current to motors provided in the primary compressor and the secondary compressor, by being open and closed according to a control signal of the microcomputer. The AC switch may be implemented as a thyristor or a TRIAC, for example.

Figure 5:
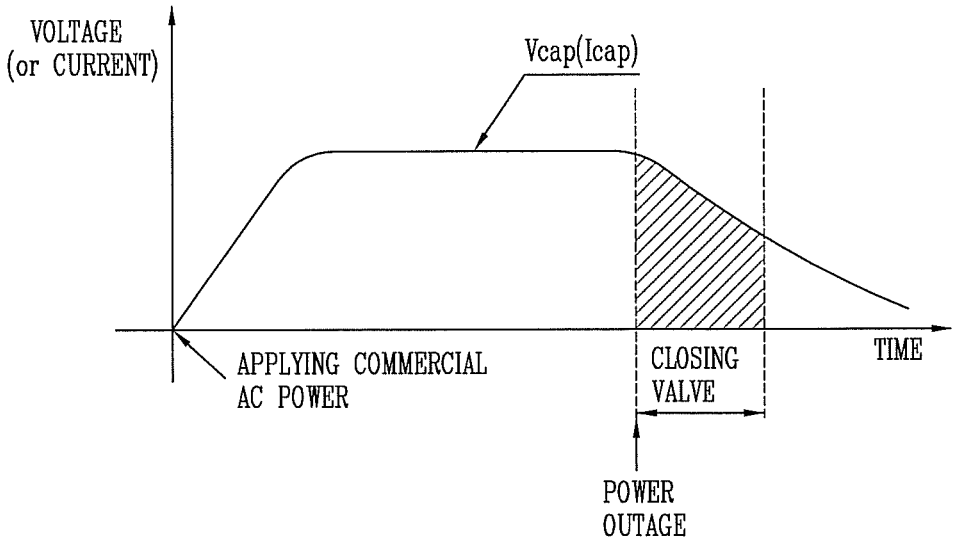
FIG. 5 is a graph showing change in voltage or current of a direct current (DC) link capacitor provided in a refrigerating cycle apparatus, for explaining an operation of a refrigerating cycle apparatus according to embodiments, during a blackout (power outage)
Figure 7:
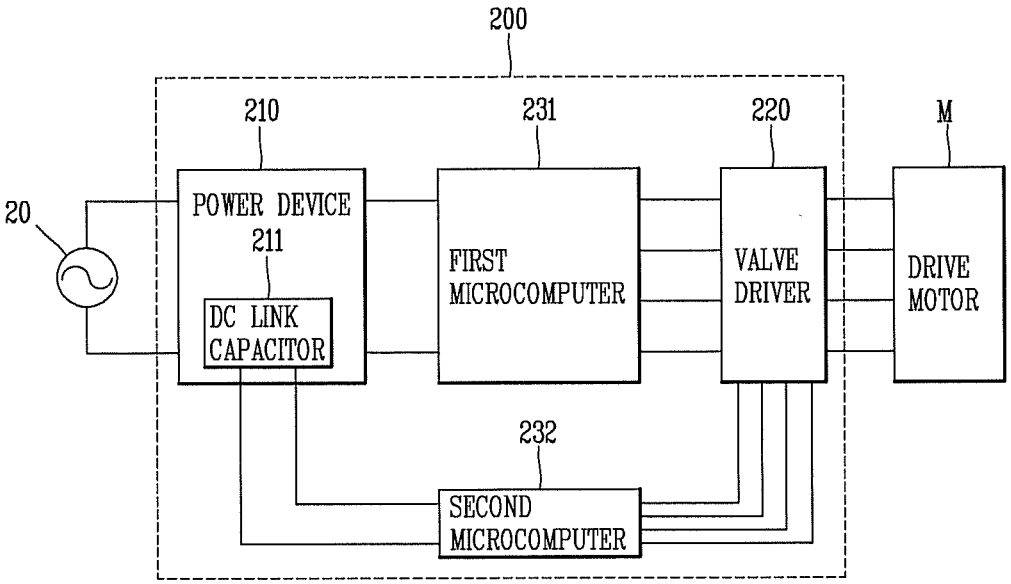

Referring to FIG. 7, a refrigerating cycle apparatus according to another embodiment may include a power device 210, a refrigerant switching valve (not shown), a valve driver 220, a first microcomputer 231, a power outage sensing circuit (not shown), and a second microcomputer 232. The refrigerating cycle apparatus according to this embodiment will be explained with reference to FIGS. 4 to 6. With this configuration, like reference numerals have been used to indicate like elements, and repetitive disclosure has been omitted.

The power device 210 may be provided with the DC link capacitor 211 to store a DC voltage, and may receive a commercial AC power, to convert a commercial AC voltage of the commercial AC power into a plurality of drive voltages, and to output the drive voltages.

The refrigerant switching valve may be driven by a valve drive signal, and supply a refrigerant through two or more refrigerant paths. The refrigerant switching valve may include a drive motor, and be opened and closed (switched) under driving of the drive motor.

The valve driver 220 may receive one drive voltage among a plurality of drive voltages output from the power device 210, and switch the refrigerant switching valve according to a valve drive signal. The first microcomputer 231 may receive one drive voltage among drive voltages output from the power device 210, and generate a valve drive signal according to an operating command. The first microcomputer 231 may control the refrigerating cycle apparatus when being normally operated. The first microcomputer 231 may perform functions of the microcomputer 230 in the previous embodiment.

The power outage sensing circuit may be configured as shown in FIG. 4, and sense whether supply of a commercial AC power has been stopped. Referring to FIG. 4, the power outage sensing circuit may include a photo coupler U1. The power outage sensing circuit may check a frequency of a commercial AC power, and transmit a sensing signal having a prescribed frequency to the first microcomputer 231. For instance, a commercial AC power of about 60 Hz and 220V may be connected to the power outage sensing circuit, and the first microcomputer 231 may consecutively receive, from the power outage sensing circuit, a sensing signal of a square wave pulse of about 60 Hz.

The second microcomputer 232 may receive a DC voltage stored in the DC link capacitor 211, and generate a valve drive signal instructing all states of the refrigerant switching valve to be closed. The second microcomputer 232 may operate when the refrigerating cycle apparatus is not supplied with a commercial AC power, for example, in the occurrence of a blackout. The second microcomputer 232 may receive a sensing signal from the power outage sensing circuit. The second microcomputer 232 may have a specification lower than that of the first microcomputer 231. The second microcomputer 232 may be used only for output of a valve driving signal to the refrigerant switching valve.

If supply of the commercial AC power 20 to the refrigerating cycle apparatus is stopped, the second microcomputer 232 may generate a valve drive signal instructing all states of the refrigerant switching valve 16 to be closed. For instance, the second microcomputer 232 may store a current state of the refrigerant switching valve among the four (4) states while the refrigerating cycle apparatus operates. Then, in the occurrence of a blackout (power outage), the second microcomputer 232 may generate a valve drive signal to thus output the valve drive signal to the valve driver 220, the valve drive signal instructing both the first outlet 16*b* and the second outlet 16*c* of the refrigerant switching valve to be closed.

Embodiments disclosed herein provide a refrigerating cycle apparatus capable of moving a refrigerant switching valve to a prescribed position when power is cut off. Embodiments disclosed herein further provide a refrigerating cycle apparatus capable of collecting oil even when an input power is cut off, for example, when a blackout (power outage) occurs during an operation.

Embodiments disclosed herein provide a refrigerating cycle apparatus that may include a refrigerant switching valve provided with a drive motor driven according to a valve driving signal, the refrigerant switching valve being configured to switch a refrigerant path to be open and closed under drive of the driving motor; and a controller configured to control an operation of the refrigerant switching valve. The controller may include a power unit or device provided with a direct current (DC) link capacitor configured to store a DC voltage therein, the power unit being configured to receive a commercial AC power, to convert an AC voltage of the commercial AC power into one or more drive voltages, and to output the drive voltages; a valve driver configured to receive one drive voltage among the drive voltages, and to output the valve drive signal to the driving motor; and a microcomputer configured to receive one drive voltage among the drive voltages, or to receive a DC voltage stored in the DC link capacitor to thus generate the valve driving signal. The microcomputer may generate the valve driving signal when supply of the commercial AC power is stopped, the valve driving signal instructing all states of the refrigerant switching valve to be closed. The refrigerating cycle apparatus may further include a power outage sensing circuit connected to the commercial AC power, and configured to sense whether supply of the commercial AC power has been stopped or not.

Embodiments disclosed herein provide a refrigerating cycle apparatus that may include a power unit or device provided with a direct current (DC) link capacitor configured to store a DC voltage therein, and the power unit being configured to receive a commercial AC power, to convert an AC voltage of the commercial AC power into one or more drive voltages, and to output the drive voltages; a refrigerant switching valve driven by a valve driving signal, and configured to supply a refrigerant through two or more refrigerant paths; a valve driver configured to receive one drive voltage among the drive voltages, and to switch the refrigerant switching valve according to the valve driving signal; a first microcomputer configured to receive one drive voltage among the drive voltages, and configured to generate the valve driving signal according to an operating command; a power outage sensing circuit connected to the commercial AC power, and configured to sense whether supply of the commercial AC power has been stopped; and a second microcomputer configured to receive the DC voltage stored in the DC link capacitor, and configured to generate the valve driving signal instructing all states of the refrigerant switching valve to be closed.

Embodiments disclosed herein have at least the following advantages.

First, the refrigerant switching valve may be moved to a prescribed position through a simple circuit structure, during a blackout (power outage). Second, in a case in which input power is cut off due to a blackout, for example, while the refrigerating cycle apparatus operates, oil may be collected. Third, even if an input power is cut off due to a drastic power outage (blackout), for example, in a state in which the refrigerant switching valve is open while the refrigerating cycle apparatus having two compressors of two stages (2tage-2comp) is operating, the refrigerant switching valve may be converted into a closed state. This may reduce a pressure difference between the two compressors, prevent damage to the compressors, and enhance stability of the system.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerating cycle apparatus, comprising:

a refrigerant switching valve operated according to a valve driving signal, the refrigerant switching valve switching a refrigerant path to be open and closed;

a primary compressor and a secondary compressor in communication with each other such that a refrigerant is two-stage compressed;

a condenser in communication with a discharge side of the secondary compressor;

a first evaporator in communication with the condenser, the first evaporator being connected to a suction side of the primary compressor; and a second evaporator in communication with the condenser, and connected between a discharge side of the primary compressor and a suction side of the secondary compressor; and a controller configured to generate the valve driving signal, using a direct current (DC) voltage stored in a DC link capacitor when supply of a commercial alternating current (AC) power stops, the valve driving signal instructing all states of the refrigerant switching valve to be closed, wherein a capacity of the secondary compressor is greater than a capacity of the primary compressor, wherein a capacity of the second evaporator is greater than a capacity of the first evaporator, wherein the refrigerant switching valve includes a first outlet connected to a suction side of the first evaporator and a second outlet connected to a suction side of the second evaporator, wherein all states of the refrigerant switching valve are determined by a state of the first outlet and a state of the second outlet, and wherein the controller stores a current state of the refrigerant switching valve among all states of the refrigerant switching valve and generates the valve driving signal according to the stored current state of the refrigerant switching valve, wherein the controller includes:

a power device provided with the direct current (DC) link capacitor, the power device receiving the commercial AC power converting an AC voltage of the commercial AC power into one or more drive voltages and outputting the one or more drive voltages;

a valve driver that receives a first drive voltage among the one or more drive voltages, and outputs the valve driving signal;

a microcomputer that receives a second drive voltage among the one or more drive voltages, or receives the DC voltage stored in the DC link capacitor, to thus generate the valve driving signal; and a power outage sensing circuit connected to the commercial AC power that senses whether the supply of the commercial AC power has stopped by using a photo coupler connected to the commercial AC power and the microcomputer.

2. The apparatus of claim 1, wherein the refrigerant switching valve includes a drive motor driven according to the valve drive signal, the refrigerant switching valve switching the refrigerant path to be open or closed in response to driving of the drive motor.

3. The apparatus of claim 1, wherein the power outage sensing circuit receives a third drive voltage among the one or more drive voltages, and outputs a signal according to a frequency of the commercial AC power to the microcomputer.

4. The apparatus of claim 1, wherein the refrigerant switching valve is installed at an outlet of the condenser, at a divergence point of the refrigerant path to the first evaporator and the second evaporator, and wherein the refrigerant switching valve is switched, such that the refrigerant is supplied to the first evaporator or the second evaporator.

5. The apparatus of claim 1, wherein the power device further includes:

a converter connected to a front end of the DC link capacitor, that converts an AC voltage into a DC voltage; and a drive voltage generator connected to a rear end of the DC link capacitor, that converts the DC voltage into one or more drive voltages.

6. The apparatus of claim 1, wherein the controller further includes a first inverter and a second inverter that convert the DC voltage into drive voltages with respect to the primary compressor and the secondary compressor, respectively, and apply the drive voltages to the primary compressor and the secondary compressor, respectively.

7. The apparatus of claim 6, wherein the controller drives the primary compressor and the secondary compressor individually or simultaneously.

8. A refrigerating cycle apparatus, comprising:

a refrigerant switching valve operated according to a valve driving signal, the refrigerant switching valve switching a refrigerant path to be open and closed;

a primary compressor and a secondary compressor in communication with each other such that a refrigerant is two-stage compressed;

a condenser in communication with a discharge side of the secondary compressor, a first evaporator in communication with the condenser, the first evaporator being connected to a suction side of the primary compressor; and a second evaporator in communication with the condenser, and connected between a discharge side of the primary compressor and a suction side of the secondary compressor; and a controller configured to generate the valve driving signal, using a direct current (DC) voltage stored in a DC link capacitor when supply of a commercial alternating current (AC) power stops, the valve driving signal instructing all states of the refrigerant switching valve to be closed such that a constant pressure is maintained between the primary compressor and secondary compressor to maintain a balance of oil in the primary compressor and secondary compressor, wherein the controller includes:

a power device provided with the direct current (DC) link capacitor;

a microcomputer that receives a second drive voltage among the one or more drive voltages, or receives the DC voltage stored in the DC link capacitor, to thus generate the valve driving signal, wherein the power device is configured to receive the commercial AC power, convert an AC voltage of the commercial AC power into one or more drive voltages, and output the one or more drive voltages; and a power outage sensing circuit connected to the commercial AC power, that senses whether the supply of the commercial AC power has stopped by using a photo coupler connected to the commercial AC power and the microcomputer, wherein the power outage sensing circuit receives a third drive voltage among the one or more drive voltages, and outputs a signal according to a frequency of the commercial AC power to the microcomputer.

9. The apparatus of claim 8, wherein the refrigerant switching valve includes a drive motor driven according to the valve drive signal, the refrigerant switching valve switching the refrigerant path to be open or closed in response to driving of the drive motor.

10. The apparatus of claim 8, wherein the refrigerant switching valve is installed at an outlet of the condenser, at a divergence point of the refrigerant path to the first evaporator and the second evaporator, and wherein the refrigerant switching valve is switched, such that the refrigerant is supplied to the first evaporator or the second evaporator.

11. The apparatus of claim 8, wherein the power device further includes:

a converter connected to a front end of the DC link capacitor, that converts an AC voltage into a DC voltage; and a drive voltage generator connected to a rear end of the DC link capacitor, that converts the DC voltage into one or more drive voltages.

12. The apparatus of claim 8, wherein the controller further includes a first inverter and a second inverter that convert the DC voltage into drive voltages with respect to the primary compressor and the secondary compressor, respectively, and apply the drive voltages to the primary compressor and the secondary compressor, respectively.

13. The apparatus of claim 12, wherein the controller drives the primary compressor and the secondary compressor individually or simultaneously.

* * * * *